United States Patent [19]

Cousins

[11] Patent Number: 4,955,102

[45] Date of Patent: Sep. 11, 1990

[54] VACUUM CLEANER BEATER BRUSH WITH A BIASED BRISTLE STRIP

[75] Inventor: Walter K. Cousins, Lexington, Ky.

[73] Assignee: Whirlpool Corporation, Benton Harbor, Mich.

[21] Appl. No.: 269,075

[22] Filed: Nov. 9, 1988

[51] Int. Cl.[5] ..... A46B 9/08

[52] U.S. Cl. ..... 15/182; 15/383; 15/360; 15/183

[58] Field of Search ..... 15/182, 183, 177, 383, 15/360

[56] References Cited

U.S. PATENT DOCUMENTS

| | | | |
|---|---|---|---|
| 2,297,366 | 9/1942 | Pierce | 15/366 X |
| 3,737,937 | 6/1973 | Nordeen | 15/366 X |
| 4,177,536 | 12/1979 | Powers | 15/182 |
| 4,372,004 | 2/1983 | Vermillion | 15/182 |
| 4,777,691 | 10/1988 | Richmond et al. | 15/366 X |

FOREIGN PATENT DOCUMENTS

| | | | |
|---|---|---|---|
| 129783 | 10/1950 | Switzerland | 15/366 |
| 388907 | 3/1933 | United Kingdom | 15/366 |

*Primary Examiner*—Frankie L. Stinson

*Attorney, Agent, or Firm*—Mason, Kolehmainen, Rathburn & Wyss

[57] ABSTRACT

A beater brush for a vacuum cleaner includes a cylindrical dowel having at least one groove helically disposed in an outer periphery thereof for receiving a bristle strip. The bristle strip has a bristle support section and a beater bar integrally formed with a hinge disposed therebetween. In the bristle strip's molded position, the beater bar is disposed a distance from the bristle support section to allow bristle tufts to be inserted in apertures formed in the bristle support section. After the bristle tufts are secured to the bristle support section, the beater bar is swung into position abutting the bristle tufts so as to impart kinetic energy thereto.

19 Claims, 1 Drawing Sheet

VACUUM CLEANER BEATER BRUSH WITH A BIASED BRISTLE STRIP

BACKGROUND OF THE INVENTION

1. Field of the Invention

The present invention relates to the beater brush of a vacuum cleaner and more particularly to a beater brush with a bristle strip having a beater bar integrally formed with a support section for the bristle tufts wherein the beater bar abuts the bristle tufts to impart kinetic energy thereto.

2. Description of the Prior Art

Known vacuum cleaners typically include a beater brush having a dowel with bristle tufts disposed in one or more helical grooves formed in the periphery of the dowel. Various beater brush configurations are shown in U.S. Pat. Nos. 1,815,077; 1,815,084; 1,889,224; 3,737,937; 4,173,807; 4,307,479; and 4,429,430.

In order to impart kinetic energy to the bristle tufts to thereby increase the effectiveness of the vacuum cleaner, beater bars positioned in back of the bristle tufts at a slight distance therefrom have been employed as shown in U.S. Pat. Nos. 4,177,536 and 4,372,004. U.S. Pat. No. 4,372,004 further shows a bristle strip having an integrally formed bristle support section and a concamerated beater bar wherein the bristle strip includes a series of spaced holes disposed along the length of the bristle support section for receiving bristle tufts and a pair of outwardly extending shoulders for retaining the bristle strip in a helical groove formed about the periphery of the beater brush dowel. The distance between the bristle tufts and the beater bar is typically present due to manufacturing constraints. This distance, however, decreases the effectiveness of the beater bar to impart kinetic energy to the bristle tufts.

SUMMARY OF THE INVENTION

In accordance with the present invention, the disadvantages of prior art vacuum cleaner beater brushes have been overcome. The vacuum cleaner beater brush of the present invention includes a bristle strip having an integrally formed bristle support section and beater bar wherein the beater bar abuts the bristle tufts extending upwardly from the bristle support section.

More particularly, the beater brush of the present invention includes a cylindrical dowel having at least one groove helically disposed in the outer periphery thereof for receiving the bristle strip. The groove is formed in the dowel with a pair of side walls each having a channel formed therein. The bristle support section of the bristle strip includes a series of spaced apertures in an upper surface for receiving the bristle tufts which are secured to the bristle support section by a staple. The bristle support section also includes a first shoulder that extends outwardly from one side of the bristle support section along the length thereof so as to be slidably received in a channel of the groove formed in the beater brush dowel. A mating surface extends outwardly from the opposite side of the bristle support section along the length thereof.

A hinge is integrally formed between the bristle support section and the beater bar to allow the beater bar to be moved from a molded position to a mounting position abutting the bristle tufts. In the molded position, the beater bar is disposed away from the apertures in the bristle support section to allow the bristle tufts to be inserted therein. In the mounting position of the beater bar, a mating surface extending along the length of the beater bar mates with the mating surface of the bristle support section with a projection extending along the length of the beater bar abutting the bristle tufts.

The hinge of the bristle strip has an inner surface forming a channel extending the length of the bristle strip and an outer surface forming a shoulder adapted to be slidably received in a channel of the groove formed in the beater brush dowel when the mating surfaces of the bristle support section and the beater bar mate.

Because the beater bar abuts the bristle tufts, the beater bar is more effective to impart kinetic energy to the bristle tufts so as to improve the cleaning action of the vacuum cleaner. Further, the hinge of the beater strip allows the beater bar to be moved away from the bristle support section so that the bristle tufts may be easily inserted therein. Manufacturing of a beater brush constructed in accordance with the present invention is thus facilitated.

These and other objects, advantages and novel features of the present invention, as well as details of an illustrated embodiment thereof, will be more fully understood from the following description and the drawing.

DESCRIPTION OF THE PREFERRED EMBODIMENT

Figures 1, 2, 3, 4, 5:
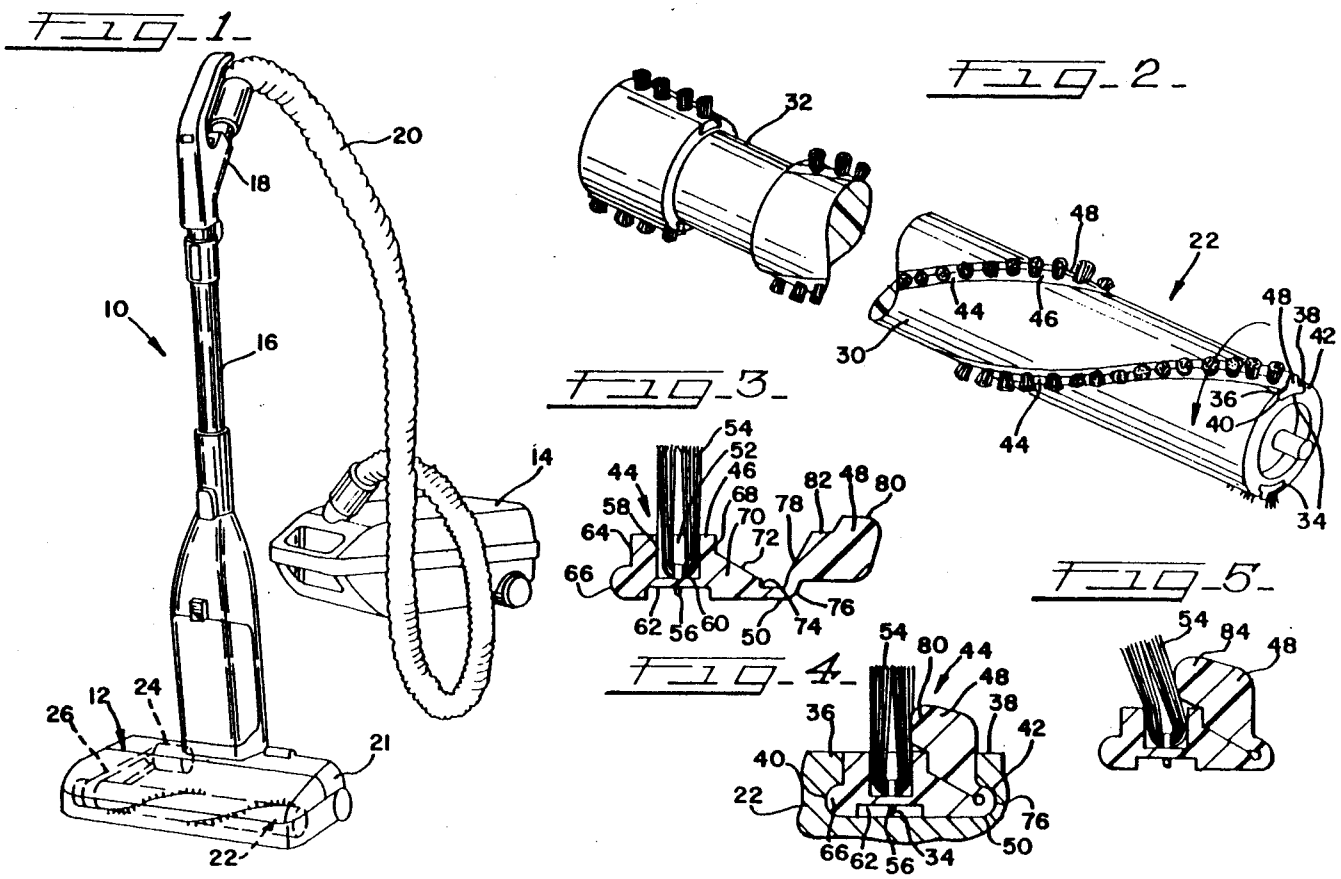
FIG. 1 is a perspective view of a vacuum cleaner having a beater brush constructed in accordance with the principles of the present invention.
FIG. 2 is a perspective view of the beater brush shown in FIG. 1.
FIG. 3 is a cross-sectional view of the bristle strip shown in FIG. 2 in its molded position.
FIG. 4 is a cross-sectional view of the bristle strip shown in FIG. 2 in its mounting position.
FIG. 5 is a cross-sectional view of an alternative embodiment of the bristle strip of the present invention.

A vacuum cleaner 10, shown in FIG. 1 and constructed in accordance with the principles of the present invention, includes a power head 12, coupled to a canister unit 14 through a wand 16, handle 18 and hose 20. Contained in a housing 21 for the power head 12 is a beater brush 22 coupled to a drive motor 24 by a flat continuous belt 26. The belt 26 extends about an output shaft of the motor 24 and about a dowel 30 of the beater brush 22, preferably seated in a groove 32 formed about the periphery of the dowel 30 as shown in FIG. 2. The beater brush dowel 30 includes a pair of grooves such as groove 34, helically disposed about the periphery of the dowel. Each groove 34 has a pair of side walls 36 and 38 with a respective channel 40 and 42 formed therein to receive a bristle strip generally designated 44.

The bristle strip 44 has a bristle support section 46 and a beater bar 48 integrally formed with a living hinge 50 disposed therebetween. The bristle support section 46 extends longitudinally along the length of the bristle strip 44 and includes a series of aligned, spaced apertures 52 formed in an upper surface for receiving bristle tufts 54. The bristle tufts 54, inserted in each aperture 52, are secured to the bristle support section 46 by a staple 56. Each of the apertures 52 has a generally cylindrically shaped inner side wall 58 and a floor 60. A shallow channel 62 is formed in a bottom surface of the bristle support section 46 opposite the floor 60 of the aperture 52 to accommodate the staples 56. Extending the length of the bristle strip 44, adjacent one side 64 of the bristle support section 46 from the base thereof, is a rounded shoulder 66. Adjacent the opposite side 68 of the bristle support section 46 and extending the length of the bristle strip 44, is a mating shoulder 70 having a downwardly and outwardly sloping top surface 72 that abuts the hinge 50.

The hinge 50 has an inner surface formed by a channel 74 that extends the length of the bristle strip 44. The outer surface 76 of the hinge 50 forms a shoulder when the beater bar 48 is in its mounting position as depicted in FIG. 4. The outer surface 76 forming the shoulder of the hinge 50 is such as to be slidably received in a channel 42 of the groove 34 formed in the beater brush dowel 22.

The beater bar 48 extends longitudinally along the length of the bristle strip 44. In its molded position, as shown in FIG. 3, the beater bar 48 has an upwardly and outwardly sloping mating surface 78 that is adapted to mate with the mating surface 72 of the bristle support section 46 when the beater bar 48 is in its mounting position as depicted in FIG. 4. The beater bar 48 further includes a raised platform or projection 80 that extends from a top surface 82 of the beater bar 48. The projection 80 extends the length of the beater bar 48 and bristle strip 44 and is such that, when the beater bar 48 is in its mounting position as shown in FIG. 4, the projection 80 abuts the bristle tufts 54 to impart kinetic energy thereto for effective cleaning. As shown in FIG. 4 for one embodiment of the present invention, the projection 80 of the beater bar 48 merely abuts the bristle tufts 54. In an alternative embodiment, as shown in FIG. 5, an enlarged projection 84 may be formed on the beater bar 48 so as to bias the bristle tufts 54 forward, away from the beater bar 48. The forwardly biased bristle tufts 54 may further improve the effectiveness of the beater brush 22.

The bristle strip 44 is molded of plastic or the like, and preferably polyethylene, in the position depicted in FIG. 3 with the beater bar 48 disposed away from the apertures 52 formed in the bristle support section 46. With the bristle strip in its molded position, the bristle tufts 54 may be easily inserted into the apertures 52 and stapled to the bristle support section 46. After the bristle tufts 54 are secured to the bristle support section 46 of the bristle strip 44, the beater bar 48 may be moved to its mounting position depicted in FIG. 4 by pivoting the beater bar 48 about the hinge 50 so that the projection 80 abuts the bristle tufts 54. In the beater bar's mounting position, the mating surface 78 of the beater bar 48 mates with the surface 72 of the bristle support section 46 with the top surface 82 of the beater bar 48 abutting the side wall 68 of the bristle support section 46. The bristle strip 44 in its mounting position may then be slidably inserted into the groove 34 formed in the beater brush dowel 30 with the shoulder 66 and the shoulder formed by the outer surface 76 of the hinge 50 disposed in respective channels 40 and 42 of the groove 34 so as to retain the bristle strip 44 secured to the beater brush dowel 30.

The beater brush 22 of the present invention is manufactured with relative ease since the beater bar 48 may be moved away from the apertures 52 formed in the bristle support section 46 to allow the bristle tufts 54 to be inserted therein. The beater bar 48 is then swung into position so that the bristle strip 44 may be inserted into the groove 34 of the dowel 30 with the projection 80 abutting the bristle tufts 54 to impart kinetic energy thereto to improve the cleaning action of the vacuum cleaner 10.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

I claim:

1. A vacuum cleaner beater brush comprising:

a cylindrical dowel having at least one groove helically disposed in the outer periphery of said dowel for receiving a bristle strip, said groove having a pair of side walls with a channel formed in each of said side walls; and a bristle strip having a bristle support section and beater bar integrally formed with a hinge disposed therebetween, said bristle support section having bristle tufts extending upwardly therefrom, a first shoulder extending outwardly from one side of said bristle support section along the length thereof so as to be slidably received in a channel of said groove and a mating surface extending outwardly from an opposite side of said bristle support section along the length thereof, said beater bar having a mating surface extending along the length thereof for mating with the mating surface of said bristle support section and having a projection extending along the length of said beater bar, said projection abutting said bristle tufts when the mating surfaces of said bristle support section and beater bar mate, and said hinge having an outer surface forming a shoulder adapted to be slidably received in a channel of said groove when the mating surface of said bristle support section and beater bar mate.

2. A vacuum cleaner beater brush as recited in claim 1 wherein the mating surface of said bristle support section slopes outwardly and downwardly.

3. A vacuum cleaner beater brush as recited in claim 1 wherein said mating surface of said bristle support section slopes outwardly and downwardly into said hinge, the inner surface of said hinge forming a channel extending the length of said bristle strip.

4. A vacuum cleaner beater brush as recited in claim 3 wherein said bristle strip is formed of molded plastic.

5. A vacuum cleaner beater brush as recited in claim 1 wherein said projection biases said tufts forward away from said beater bar.

6. A vacuum cleaner beater brush as recited in claim 1 wherein said bristle strip is formed of molded plastic.

7. A vacuum cleaner beater brush as recited in claim 1 wherein said bristle support section includes a series of spaced apertures in an upper surface for receiving said bristle tufts, said bristle tufts being secured in each aperture by a staple.

8. A vacuum cleaner beater brush as recited in claim 7 wherein said bristle support section includes a channel disposed in a bottom surface of said bristle support section opposite said apertures to accommodate said staples.

9. A bristle strip for a vacuum cleaner beater brush having a dowel with at least one groove in the periphery thereof said groove having a pair of side walls with a channel formed in each of said side walls, comprising:

a bristle support section having bristle tufts extending upwardly therefrom, a first shoulder extending outwardly from one side of said bristle support section along the length thereof so as to be slidably received in a channel of said groove and a mating surface extending outwardly from an opposite side of said bristle support section along the length thereof, a beater bar having a mating surface extending along the length thereof for mating with the mating surface of said bristle support section and having a projection extending along the length of said beater bar, said projection abutting said bristle tufts when the mating surfaces of said bristle support section and beater bar mate, a hinge disposed between and integrally formed with said bristle support section and said beater bar, said hinge having an outer surface forming a shoulder adapted to be slidably received in a channel of said groove when the mating surface of said bristle support section and beater bar mate.

10. A bristle strip for a vacuum cleaner beater brush as recited in claim 9 wherein the mating surface of said bristle support section slopes outwardly and downwardly.

11. A bristle strip for a vacuum cleaner beater brush as recited in claim 9 wherein said mating surface of said bristle support section slopes outwardly and downwardly into said hinge, the inner surface of said hinge forming a channel extending the length of said bristle strip.

12. A bristle strip for a vacuum cleaner beater brush as recited in claim 11 wherein said bristle strip is formed of molded plastic.

13. A bristle strip for a vacuum cleaner beater brush as recited in claim 11 wherein said projection biases said tufts forward away from said beater bar.

14. A bristle strip for a vacuum cleaner beater brush as recited in claim 11 wherein said bristle support section includes a series of spaced apertures in an upper surface for receiving said bristle tufts, said bristle tufts being secured in each aperture by a staple.

15. A bristle strip for a vacuum cleaner beater brush as recited in claim 14 said bristle support section includes a channel disposed in a bottom surface of said bristle support section opposite said apertures to accommodate said staples.

16. A vacuum cleaner beater brush comprising:

a bristle strip having a bristle support section and beater bar integrally formed with a hinge disposed therebetween, said beater bar having a projection extending therefrom and being movable toward said bristle support section;

a cylindrical dowel having at least one groove disposed in the outer periphery of said dowel for receiving said bristle strip, said groove having channel means formed therein;

said bristle support section having bristle tufts extending upwardly therefrom; and said hinge having shoulder means adapted to be slidably received in said channel means of said groove such that said beater bar is moved toward said support section and said projection abuts against said bristle tufts.

17. A vacuum cleaner beater brush as recited in claim 16 wherein said dowel is adapted to be rotated in a specified direction and said projection is positioned behind said tufts as said dowel is being rotated.

18. A vacuum cleaner beater brush as recited in claim 16 wherein said bristle support section includes aperture means for receiving said bristle tufts.

19. A vacuum cleaner beater brush as recited in claim 16 wherein said hinge is a living hinge.

* * * * *